US006052139A

United States Patent [19]

Hetzer

[11] Patent Number: 6,052,139

[45] Date of Patent: Apr. 18, 2000

[54] THERMAL TRANSFER PRINTING DEVICE

[75] Inventor: Ulrich Hetzer, Berlin, Germany

[73] Assignee: Francotyp Postalia AG & Co., Berlin

[21] Appl. No.: 09/369,719

[22] Filed: Aug. 6, 1999

[30] Foreign Application Priority Data

Aug. 6, 1998 [DE] Germany ..... 198 35 544

[51] Int. Cl.[7] ..... B41J 2/335

[52] U.S. Cl. ..... 347/200; 347/201

[58] Field of Search ..... 347/200, 201; 400/248

[56] References Cited

U.S. PATENT DOCUMENTS 4,947,183 8/1990 Yagino ..... 347/201

*Primary Examiner*—Huan Tran
*Attorney, Agent, or Firm*—Herbert L. Lerner; Laurence A. Greenberg; Werner H. Stemer

[57] ABSTRACT

A thermal transfer printing device includes a thermal printing head of the corner-edge type having heating elements disposed on one edge and forming a printing bar. The edge faces a backing roller, is parallel to the axis thereof, and around which an ink ribbon is led directly away from a letter or envelope to be printed. A shell which is provided on the underside of the thermal printing head faces the backing roller. The shell extends immediately up to the printing bar and has a bottom surface with a region adjacent the printing bar at approximately the same height as the printing bar. The thermal printing head including the shell and the backing roller, are adjustable relative to one another. Good ink particle detachment and a relatively low contact force are provided. Disadvantages with regard to soft and sensitive mail can be avoided and the service life of the thermal printing head is prolonged due to a lower contact force. A good print quality is achieved, irrespective of the finish of the letters or envelopes and at a high transport speed of the latter.

9 Claims, 3 Drawing Sheets

THERMAL TRANSFER PRINTING DEVICE

BACKGROUND OF THE INVENTION

1. Field of the Invention

The invention relates to a thermal transfer printing device for a franking and/or addressing machine.

In the thermal transfer printing process, a printing medium is usually led between a thermal printing head and a backing roller disposed opposite the latter, on the side of the backing roller. An ink ribbon is led through on the side of the thermal printing head. It is necessary for the printing head to rest on the ink ribbon with an appropriately high force and for the ribbon to in turn rest on the printing medium, in order to transfer molten ink particles from the ink ribbon to the printing medium.

The ink may be bonded to the ink ribbon in a wax layer, or recently in a layer of polyimide as well.

In the case of an office printer which works on the thermal transfer printing principle, operations are carried out with constant printing relationships, such as the same contact force for the thermal printing head, single sheets of a prescribed paper grade, in particular paper thickness, and constant paper guidance.

Contrary to the office printer, in the case of franking and/or addressing machines, the finish of the letters, in particular their thickness and stiffness, frequently changes because of different fillings and the paper quality of the envelopes.

The printing relationships become particularly critical in the case of processing air mail, since the envelopes used therefor are often very soft and sensitive. Although more careful operation would be possible by reducing the contact pressure, the print quality would then in turn be correspondingly impaired. On the contrary, in the case of so-called soft letters, the contact pressure must even be increased with respect to normal letters in order to achieve the same print quality. However, higher contact forces in turn result in greater wear on the thermal printing head and, accordingly, to a correspondingly shortened service life, and may additionally lead to damage to the letters.

Published European Patent Application 0 787 592 A1 discloses a thermal printer in which the letters are led along while lying flat along the broad side of a thermal printing head. The heating elements are disposed in the center of the plate-like printing head, in a row transverse to the transport direction of the letter or envelope. The letter, together with the ink ribbon, is pressed against the heating elements through the use of a spring-mounted roll. The broad side is significantly larger in comparison with the region having the heating elements, so that the ink ribbon and letter, following the printing operation, are guided in such a way that they rest on one another for a relatively long time.

Due to the contact over a large area, that method of guiding the letters certainly takes care of the paper, but the ink particles are more difficult to detach from the ink ribbon. Compensation is possible only through the use of a longer thermal action time, which in turn necessitates a lower transport speed. In addition, because of the greater contact area, a higher contact force is required, as a result of which once more the thermal printing head wears more rapidly.

The conditions are similar in another franking machine known from Published European Patent Application 0 724 234 A2, in which the row of heating elements is displaced more to one end of the plate-like thermal printing head. However, the joint path of the ink ribbon and the letter, following the thermal action, is still too long, since the ink ribbon is only led away from the letter by a deflection roller disposed downstream.

Furthermore, a thermal transfer printing device is known from European Patent 0 434 340 B1, in which the heating elements are fitted to one edge of a thermal printing head, and the latter only presses in the direction of a backing roller with that edge. The ink ribbon is pivoted away from the letter over a roll disposed downstream of the edge. In that case too, the residence time of the ink ribbon on the letter is still too long. Added to that is the fact that the edge of the thermal printing head, which is provided with a small radius of curvature, loads the letter mechanically so severely that, in the case of envelopes made of thin paper and having a multilayer soft filling, it is possible for creases to arise, extending through to damage. In addition, that results in a correspondingly poorer print quality.

Finally, a thermal printer is further known from Published European Patent Application 0 329 478 A1, in which the heating elements are fitted directly to a narrow front edge of a flat thermal printing head, and the ink ribbon is led away from the printing medium directly downstream of the heating element printing bar. Favorable conditions are provided in that way in relation to the detachment of ink particles, but any use for multilayer printing media, such as soft letters, is associated with the risk of creasing.

That thermal printing head represents the so-called "corner-edge type", while the two devices described at the beginning correspond to the so-called "flat type".

SUMMARY OF THE INVENTION

The purpose of the invention is to improve functional properties and to widen the field of use. It is accordingly an object of the invention to provide a thermal transfer printing device, which overcomes the hereinafore-mentioned disadvantages of the heretofore-known devices of this general type, which achieves a good print quality irrespective of finish, quality or condition of letters or envelopes and at a high transport speed of the latter and which keeps wear on the thermal printing head as low as possible.

With the foregoing and other objects in view there is provided, in accordance with the invention, a thermal transfer printing device for franking and/or addressing machines, comprising a backing roller having an axis; a thermal printing head of the corner-edge type having an underside facing the backing roller, an edge for leading an ink ribbon around the edge directly away from a letter or envelope to be printed, the edge disposed closest to the backing roller, facing the backing roller and parallel to the axis of the backing roller, and heating elements disposed on the edge and forming a printing bar disposed at a given height; a shell disposed on the underside of the thermal printing head and extending directly up to the printing bar, the shell having a bottom surface with a region adjacent the printing bar at approximately the given height; and the backing roller and the thermal printing head with the shell adjustable relative to one another.

In accordance with another feature of the invention, the shell has an edge rounded off towards the thermal printing head in a region adjacent the printing bar, the shell is broader than the thermal printing head, and the shell has rounded corners in an extension of the edge of the thermal printing head.

In accordance with a further feature of the invention, the edge of the thermal printing head has a given length, and the backing roller is longer than the printing bar but shorter than the given length.

In accordance with an added feature of the invention, the shell is detachably fastened to the thermal printing head.

In accordance with an additional feature of the invention, the shell is formed of a non-rusting metal, the shell has a region adjacent the printing bar, the shell has an insulation layer supporting the shell on the thermal printing head in the region, and the bottom surface of the shell is smoothed in the region.

In accordance with yet another feature of the invention, the shell is formed of a plastic with a low coefficient of friction, such as an acetal copolymer with TEFLON.

In accordance with a concomitant feature of the invention, the shell is formed of a metal, such as aluminum, with a TEFLON coating.

The combination of a commercially available thermal printing head of the corner-edge type with the shell shaped according to the invention makes it possible, contrary to expectations, to use such a thermal printing head and to benefit from its advantages, namely good ink particle detachment and lower contact force, for franking and/or addressing machines.

As a result of placing the shell on the underside of the thermal printing head, and extending it as far as immediately by the printing bar, careful pre-smoothing of the letters is achieved without the contact force between the thermal printing head and the backing roller having to be increased for a good print quality. Due to the lower contact force, the thermal printing head itself is also taken care of, and as a result its service life is prolonged.

Other features which are considered as characteristic for the invention are set forth in the appended claims.

Although the invention is illustrated and described herein as embodied in a thermal transfer printing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
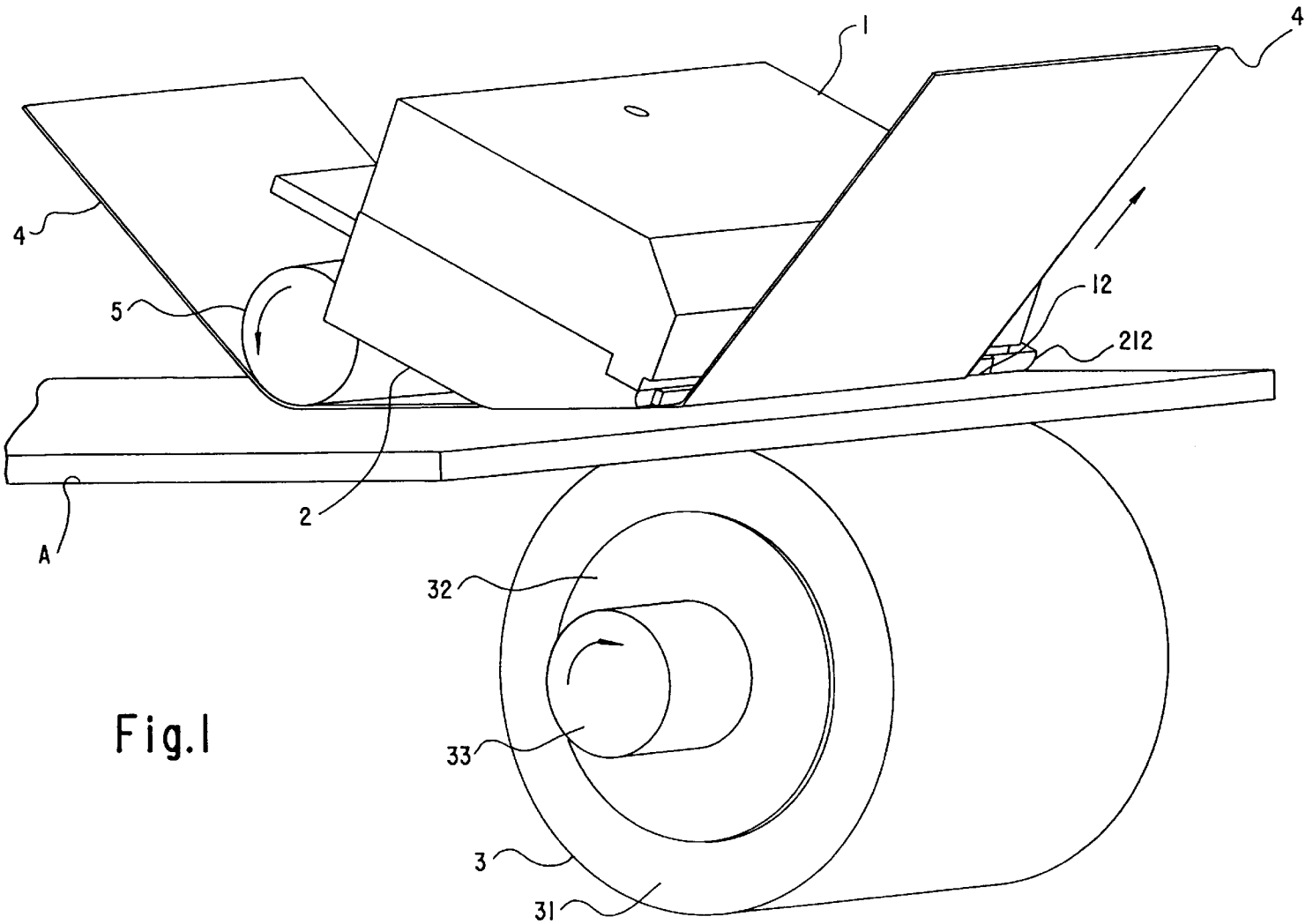
FIG. 1 is a fragmentary, diagrammatic, right-side perspective view of a thermal transfer printing device according to the invention.
Figures 2A, 2B:
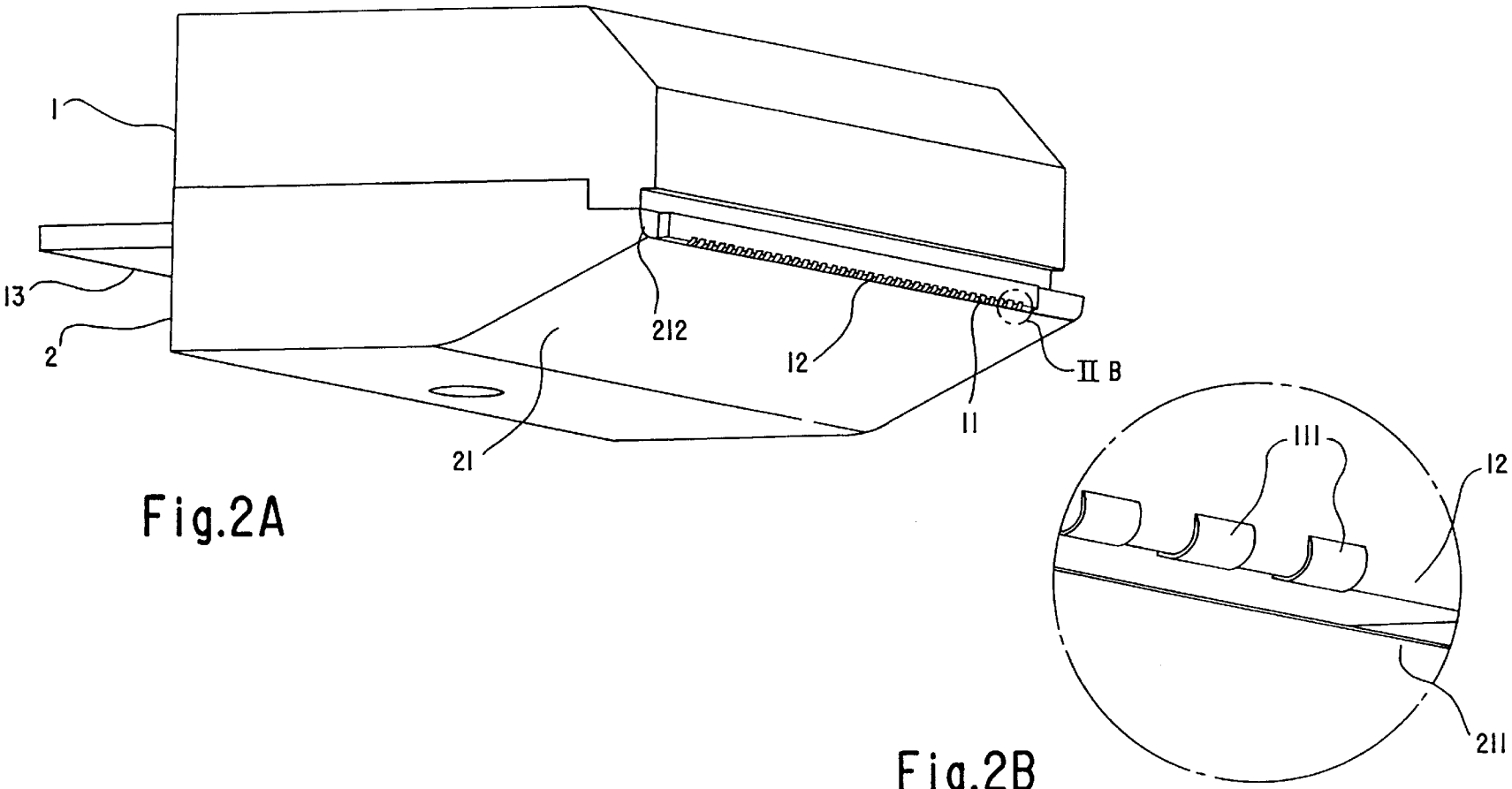
FIG. 2A is a perspective view of a thermal printing head with a shell on the underside.
FIG. 2B is an enlarged perspective view of a bottom portion IIB of FIG. 2A.

Referring now in detail to the figures of the drawings, which are somewhat diagrammatic for the purpose of simplification and ease of understanding, and first, particularly, to FIG. 1 thereof, there is seen a letter or envelope A which is disposed between an ink ribbon 4 and a backing or counter roller 3. A thermal printing head 1 and a shell 2 located on the underside of the thermal printing head, rest on the ink ribbon 4. The thermal printing head 1 is of the corner-edge type and makes contact with the ink ribbon 4 only at its edge 12. A printing bar 11 made of individual heating elements 111 is fitted to the edge 12, as is seen in FIGS. 2A and 2B. The shell 2 has a bottom surface 21 which makes contact with the ink ribbon 4 only in a region that is located in the vicinity of the edge 12 and the printing bar 11. The shell 2 is extended at two outer edges as far as a location just in front of the edge 12, and is provided with rounded corners 212.

The shell 2 and the thermal printing head 1 are constructed to be broader than the ink ribbon 4, at least in that region which makes contact with the ink ribbon 4. Due to the rounded edges of the shell 2, the letter or envelope A is carefully smoothed.

The shell 2 expediently is formed of a non-rusting metal and the bottom surface 21 is smoothed in a sliding region of the ink ribbon 4 and of the letter or envelope A. It is also possible to use a plastic, an acetal copolymer or a TEFLON-coated metal.

Figure 3A:
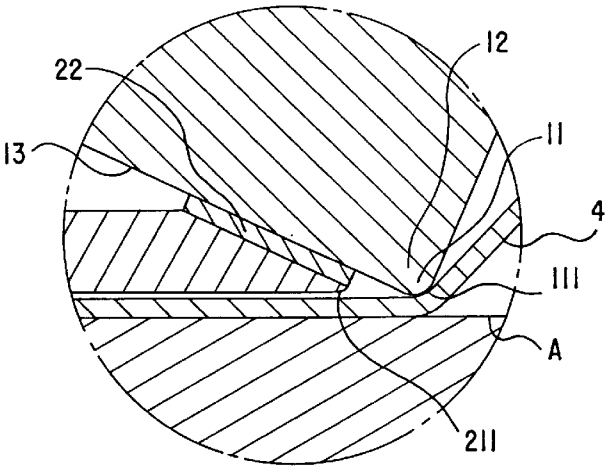
FIG. 3A is an enlarged, longitudinal-sectional view of a portion IIIA of FIG. 3.
Figure 3B:
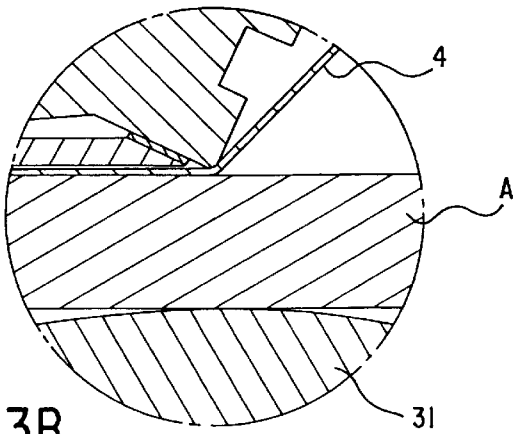
FIG. 3B is an enlarged, longitudinal-sectional view of a portion IIIB of FIG. 3.
Figure 3:
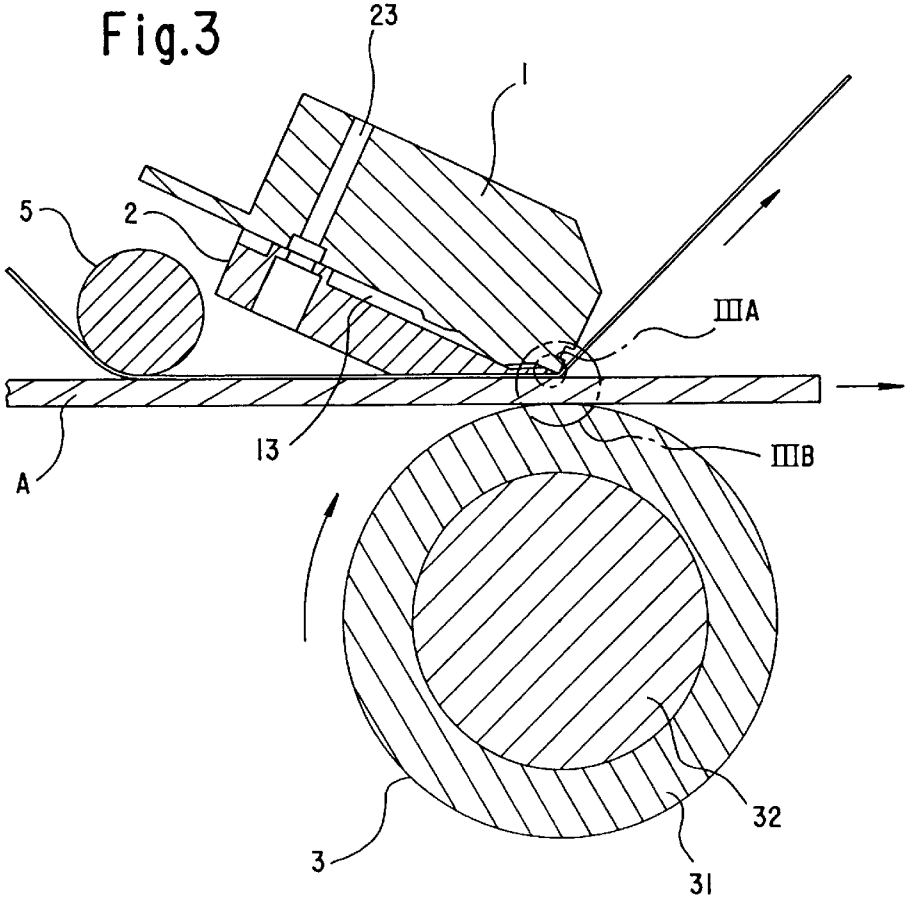
FIG. 3 is a fragmentary, longitudinal-sectional view of the device shown in FIG. 1.

The ink ribbon 4 is guided around a deflection roller 5 upstream of the shell 2, in such a way that a lower edge of the deflection roller 5, the bottom surface 21 and the printing bar 11 lie in one plane, as is also seen in FIG. 3. The ink ribbon 4 is stored in a non-illustrated conventional ink ribbon cassette having an unwinding spool for fresh ink ribbon and a winding spool for used ink ribbon. The ink ribbon 4 passes from the unwinding spool around the deflection roller 5, along the bottom surface 21, to the edge 12 having the printing bar 11, and around the latter to the winding spool in accordance with the direction of the arrow.

The backing roller 3 is located axially parallel under the edge 12. The backing roller 3 and the edge 12 are adjustable relative to one another with a contact force corresponding to a required pressure for the action of heat on the ink ribbon 4, in order to achieve reliable transfer of ink particles to the letter or envelope. The deflection roller 5 and the backing roller 3 are rotated in accordance with the direction of the arrows as shown. In the case of the backing roller 3, a resilient covering 31 with a good coefficient of friction is applied to a solid base body 32, which in turn surrounds an axle 33.

According to FIG. 2A, the shell 2 is fitted to a lower surface 13 of the thermal printing head 1 so as to have largely the same contour.

The heating elements 111 of the printing bar 11 are fitted equidistantly to the edge 11, as can easily be seen in the enlarged view of FIG. 2B. The ink layer on the ink ribbon 4 is partially detached by using the heating elements 111, depending on the activation pattern, and then the ink particles are transferred to the letter or envelope A through the use of adhesion.

FIG. 3 shows how the shell 2 is fastened through the use of a single screw connection 23 to the thermal printing head 1. FIG. 3A shows that the bottom surface 21 of the shell 2 has a rounded edge 211 which is supported on the underside 13 of the thermal printing head 1, close to the edge 12, through an insulation layer 22. The heating elements 111 surround the edge 12 in the form of the printing bar 11.

I claim:

1. A thermal transfer printing device for franking and/or addressing machines, comprising:

a backing roller having an axis;

a thermal printing head of the corner-edge type having an underside facing said backing roller, an edge for leading an ink ribbon around said edge directly away from a letter or envelope to be printed, said edge disposed closest to said backing roller, facing said backing roller and parallel to said axis of said backing roller, and heating elements disposed on said edge and forming a printing bar disposed at a given height;

a shell disposed on said underside of said thermal printing head and extending directly up to said printing bar, said shell having a bottom surface with a region adjacent said printing bar at approximately said given height; and said backing roller and said thermal printing head with said shell adjustable relative to one another.

2. The device according to claim 1, wherein said shell has an edge rounded off towards said thermal printing head in a region adjacent said printing bar, said shell is broader than said thermal printing head, and said shell has rounded corners in an extension of said edge of said thermal printing head.

3. The device according to claim 1, wherein said edge of said thermal printing head has a given length, and said backing roller is longer than said printing bar but shorter than said given length.

4. The device according to claim 1, wherein said shell is detachably fastened to said thermal printing head.

5. The device according to claim 1, wherein said shell is formed of a non-rusting metal, said shell has a region adjacent said printing bar, said shell has an insulation layer supporting said shell on said thermal printing head in said region, and said bottom surface of said shell is smoothed in said region.

6. The device according to claim 1, wherein said shell is formed of a plastic with a low coefficient of friction.

7. The device according to claim 6, wherein said plastic is an acetal copolymer with TEFLON.

8. The device according to claim 1, wherein said shell is formed of a metal with a TEFLON coating.

9. The device according to claim 1, wherein said shell is formed of aluminum.

* * * * *